US010208770B2

(12) United States Patent
Arai et al.

(10) Patent No.: US 10,208,770 B2
(45) Date of Patent: Feb. 19, 2019

(54) AXIAL FLOW FAN

(71) Applicant: MITSUBISHI ELECTRIC CORPORATION, Chiyoda-ku, Tokyo (JP)

(72) Inventors: Toshikatsu Arai, Tokyo (JP); Hitoshi Kikuchi, Tokyo (JP); Tsutomu Takahashi, Tokyo (JP); Tatsushi Murakami, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 374 days.

(21) Appl. No.: 15/117,399

(22) PCT Filed: Feb. 24, 2014

(86) PCT No.: PCT/JP2014/054359
§ 371 (c)(1),
(2) Date: Aug. 8, 2016

(87) PCT Pub. No.: WO2015/125306
PCT Pub. Date: Aug. 27, 2015

(65) Prior Publication Data
US 2016/0348700 A1 Dec. 1, 2016

(51) Int. Cl.
*F04D 29/66* (2006.01)
*F04D 19/00* (2006.01)
(Continued)

(52) U.S. Cl.
CPC ..... *F04D 29/666* (2013.01); *F04D 19/002* (2013.01); *F04D 29/329* (2013.01);
(Continued)

(58) Field of Classification Search
CPC .... F04D 29/666; F04D 29/384; F04D 29/329; F04D 19/002; F05D 2240/304; F05D 2240/303
See application file for complete search history.

(56) References Cited

U.S. PATENT DOCUMENTS 5,649,807 A 7/1997 Lee et al.
6,296,446 B1 10/2001 Ishijima et al.
(Continued)

FOREIGN PATENT DOCUMENTS

JP 8-312589 A 11/1996
JP 9-68199 A 3/1997
(Continued)

OTHER PUBLICATIONS

International Search Report (PCT/ISA/210) dated May 13, 2014, by the Japanese Patent Office as the International Searching Authority for International Application No. PCT/JP2014/054359.
(Continued)

*Primary Examiner* — Dwayne J White
*Assistant Examiner* — Adam W Brown
(74) *Attorney, Agent, or Firm* — Buchanan Ingersoll & Rooney PC

(57) ABSTRACT

An axial flow fan improves air capacity and static pressure characteristics, and can ease stress at a leading edge portion of a blade base, even when a shape for noise reduction is adopted. An axial flow fan includes a boss portion and rotor blades. A rotor blade is segmented into a first area extending from the boss portion toward the outer peripheral side, and a second area connected to the first area and extending from the first area to the outermost periphery of the rotor blade. The distribution of a forward sweep angle varies quadratically in the first area, and the maximum forward sweep angle in the first area is not larger than the forward sweep angle in
(Continued)

the second area. The distribution of chord-pitch ratio varies in a curved manner from the base as the minimum value in the first area, and is linear in the second area.

4 Claims, 7 Drawing Sheets

(51) Int. Cl.
*F04D 29/32* (2006.01)
*F04D 29/38* (2006.01)

(52) U.S. Cl.
CPC ..... *F04D 29/384* (2013.01); *F05D 2240/303* (2013.01); *F05D 2240/304* (2013.01)

(56) References Cited

U.S. PATENT DOCUMENTS 6,328,533 B1 * 12/2001 Decker ..... F01D 5/141 416/223 A
6,394,754 B1 * 5/2002 Choi ..... F04D 29/325 416/223 R
6,544,010 B1 * 4/2003 Choi ..... F04D 19/002 416/223 R
8,177,496 B2 * 5/2012 Wilson ..... F01D 5/141 415/181
8,328,412 B2 * 12/2012 Higbee ..... B01F 7/00341 366/270
2006/0228206 A1 10/2006 Decker et al.

FOREIGN PATENT DOCUMENTS

JP 2932975 B 8/1999
JP 2000-110789 A 4/2000
JP 2006-291955 A 10/2006
JP 5079063 B2 11/2012

OTHER PUBLICATIONS

Written Opinion (PCT/ISA/237) dated May 13, 2014, by the Japanese Patent Office as the International Searching Authority for International Application No. PCT/JP2014/054359.

* cited by examiner

PRIOR ART

PRIOR ART

PRIOR ART

FIG. 12
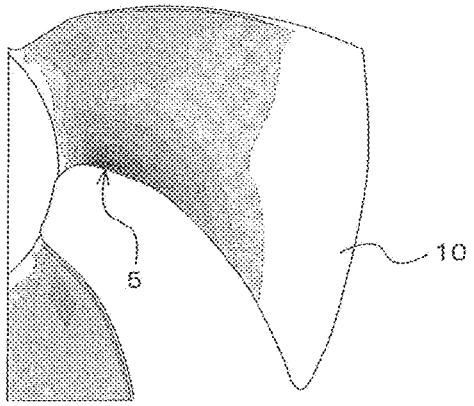
FIG. 13
| ROTOR BLADE | MAXIMUM STRESS (MPa) | RATIO TO CONVENTIONAL ART (%) |
|---|---|---|
| CONVENTIONAL | 5.84 | |
| INCREASE ONLY IN CHORD LENGTH ON INNER PERIPHERAL SIDE OF BLADE | 4.19 | 71.7 |
| EMBODIMENT | 4.27 | 73.1 |
FIG. 14
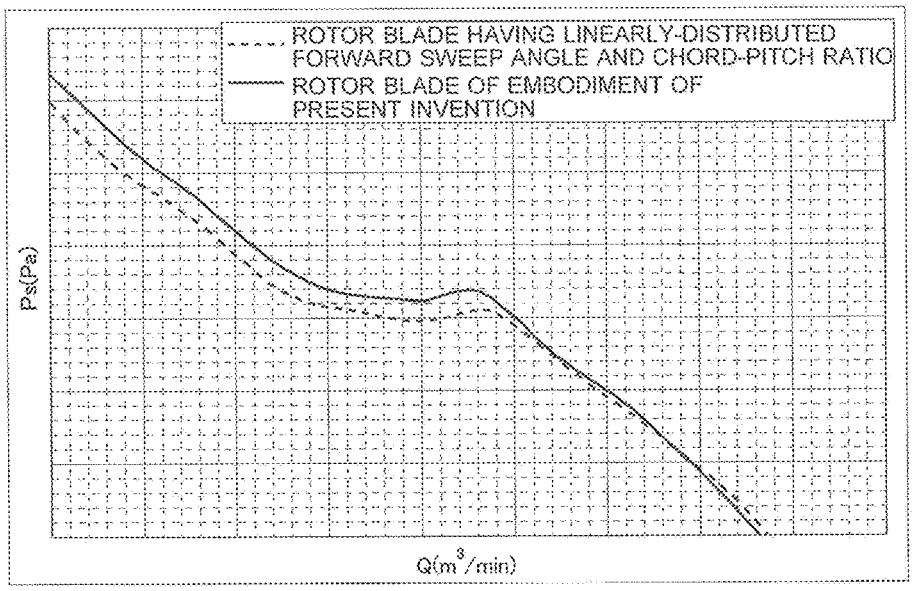

AXIAL FLOW FAN

TECHNICAL FIELD

The present invention relates to an axial flow fan used in a ventilator, air conditioner, cooling fan, and other air blowing devices.

BACKGROUND ART

Rotor blades of an axial flow fan are swept forward in the rotation direction and tilted frontward toward the upstream side of a suction airflow mainly to reduce noise, and also outer diameters and chord length of the rotor blades are enlarged within the limit of product size, to increase air capacity and static pressure.

As described above, when adopting a shape aimed for larger air capacity and higher static pressure as well as noise reduction, a blade is often formed into a shape such that stress concentrates in the base of the leading edge of the blade. However, strength to withstand wind drifts and gusts also needs to be secured.

Conventionally, there has been an axial flow fan (see Patent Literature 1, for example), in which the plate thickness of the stress-concentrating part as described above is varied to avoid concentration of stress.

Additionally, there has been an axial flow fan (see Patent Literature 2, for example), in which a part of a leading edge portion of a vane closer to a boss portion than an arbitrary point on the leading edge portion of the vane is extended in the rotation direction, as if the part of the leading edge portion of the vane on the boss portion side is continuous. Thus, concentration of stress can be avoided without locally increasing the thickness of the blade near the boss portion.

CITATION LIST

Patent Literature

Patent Literature 1: Japanese Patent No. 5079063
Patent Literature 2: Japanese Patent No. 2932975

SUMMARY OF INVENTION

Technical Problem

To enhance the air-blowing characteristic and achieve noise reduction in an axial flow fan used, for example, for ventilation or in an outdoor unit of an air conditioner, the chord length is increased within the limitation of a product, since a longer chord length can achieve better air-blowing and noise characteristics. In particular, to ensure blade strength, a longer chord length of the base portion of the blade is advantageous for increasing the strength.

However, when the rotor blades are molded integrally by using resin or metal, unless the blades are separated by a certain distance to allow removal of a die, the molding will be difficult and cost will be increased. For this reason, the blades need to be separated sufficiently far apart. However, when the part of the leading edge portion of the vane closer to the boss portion than the arbitrary point on the leading edge portion of the vane is extended in the rotation direction as in Patent Literature 2, base portions of the blades cannot be separated sufficiently far apart.

Also, for increase in strength, for example, a method of locally increasing the plate thickness of the base portion of the blade is employed as in Patent Literature 1, or a method of adopting a ribbed shape is employed. However, the increase in plate thickness of the base portion of the blade or the ribbed shape causes discontinuity in plate thickness during molding. Therefore, during molding, uneven cooling and shrinkage occur, and the whole blade may be contorted.

Also, recent rotor blades often have blades swept forward and tilted frontward, or are formed such that the outer periphery of the blades curve toward the upstream side of an airflow. Hence, stress on the base portion of the blade tends to increase due to deformation of the outer periphery of the vane, and other reasons.

The present invention solves the above problems, and aims to provide an axial flow fan that can improve the air capacity and static pressure characteristics, and can ease stress on a leading edge portion of the base of a blade, even when a shape aimed for noise reduction is adopted.

Solution to Problem

To solve the above problems and achieve the objective, an axial flow fan of the present invention includes a boss portion rotationally driven by a motor, and multiple rotor blades attached to the boss portion in a radial manner and blowing air in a rotation axis direction. Each of the multiple rotor blades is segmented into a first area extending from the boss portion toward an outer peripheral side, and a second area connected to the first area and extending from the first area to an outermost periphery of the rotor blade. A distribution of a forward sweep angle varies quadratically in the first area, and a maximum value of the forward sweep angle in the first area is a value not larger than the forward sweep angle in the second area. A distribution of a chord-pitch ratio varies in a curved manner from a base as a minimum value in the first area, and is linear in the second area.

Advantageous Effects of Invention

According to the present invention, employing the above configuration has the effect of achieving a fan that can ease stress in a stress-concentrating part of a rotor blade and that can reduce deterioration of the air-blowing and noise characteristics.

BRIEF DESCRIPTION OF DRAWINGS

FIG. 12 is a diagram illustrating stress distribution on the rotor blade of the Embodiment.

FIG. 13 is a comparative table on the maximum stress.

FIG. 14 is a diagram illustrating the air-blowing and static pressure characteristics of the rotor blade of the Embodiment and of the conventional rotor blade.

DESCRIPTION OF EMBODIMENTS

Hereinafter, an Embodiment of an axial flow fan of the present invention will be described in detail, with reference to the drawings. Note that the present invention is not limited to the Embodiment.

Embodiment

Before describing an Embodiment of the present invention, the reason for employing the configuration of the Embodiment will be explained with reference to FIGS. 1 to 5.

Figure 1:
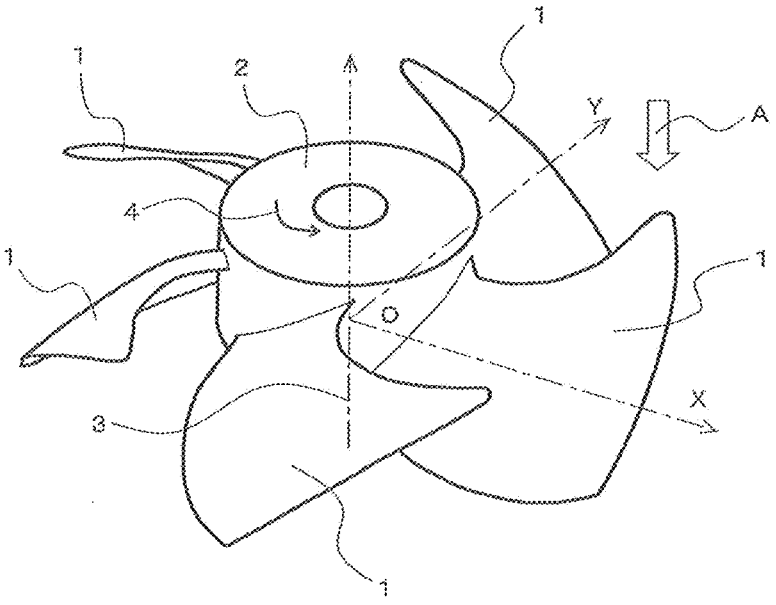
FIG. 1 is a perspective view of rotor blades of an axial flow fan.
Figure 2:
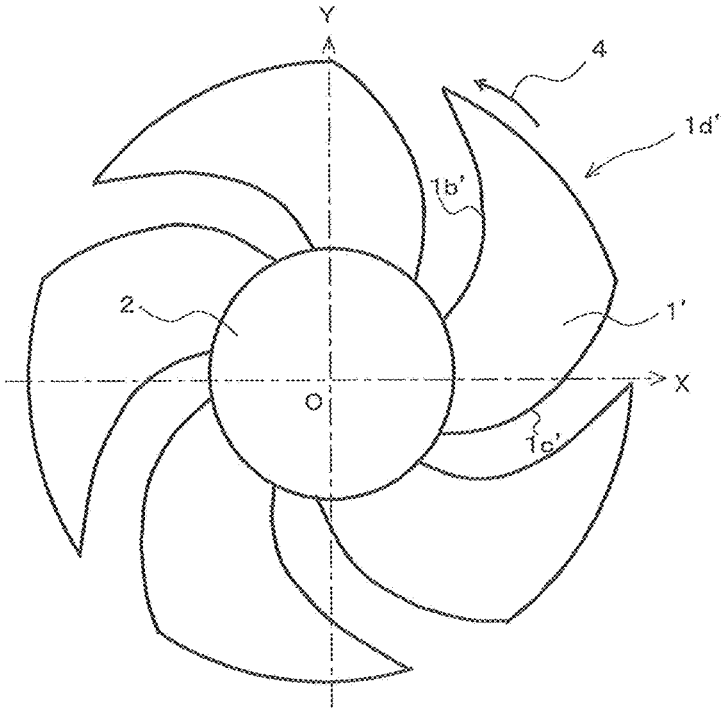
PRIOR ART FIG. 2
FIG. 2 is a plan view of the rotor blades of FIG. 1 in an X-Y plane perpendicular to a rotation axis.

FIG. 1 is a perspective view of rotor blades of an axial flow fan, and FIG. 2 is a plan view in which the rotor blades of FIG. 1 are projected on an X-Y plane perpendicular to a rotation axis 3. Note that although the axial flow fan of FIG. 1 has five rotor blades 1 as an example, the Embodiment may include other numbers of rotor blades. Although the following description on the rotor blade 1 will be given by mainly describing the shape of one rotor blade, the other rotor blades have the same shape.

As shown in FIG. 1, the rotor blades 1 each has a three dimensional shape, which is as a whole tilted rearward toward the downstream direction of an airflow, and the bases of the blades are attached to the outer periphery of a columnar boss portion 2 in a radial manner. The boss portion 2 is rotationally driven around the rotation axis 3 by an unillustrated motor, whereby the rotor blade 1 is rotated in an arrow 4 direction. Rotation of the rotor blade 1 in the arrow 4 direction generates an airflow in an arrow A direction. The upstream side of the rotor blade 1 is a suction surface, and the downstream side thereof is a pressure surface.

Figure 3:
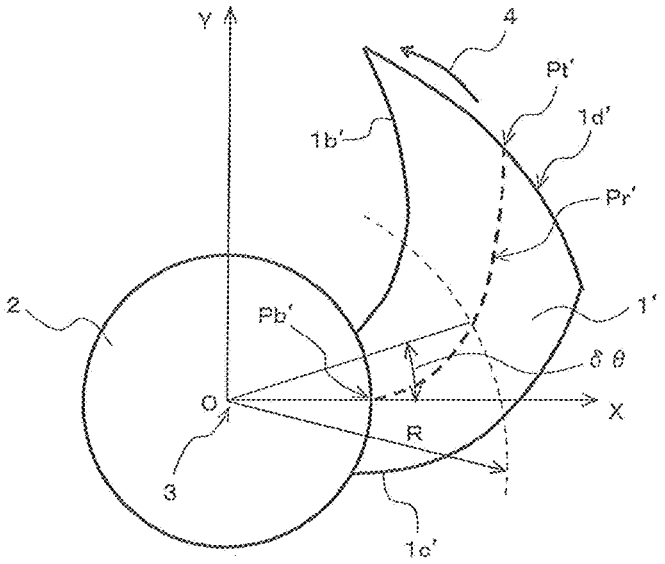
FIG. 3 is a diagram illustrating the definition of a forward sweep angle, by extracting only one blade from the rotor blades of FIG. 2.

FIG. 3 is a diagram illustrating the definition of a forward sweep angle, by extracting only one of rotor blades 1' of FIG. 2.

In FIG. 3, reference sign Pt' indicates a center point (midpoint) of a chord line between a blade leading edge portion 1*b*' and a blade trailing edge portion 1*c*', on a blade outer peripheral portion 1*d*'. Line Pr' indicates a locus of center points of chord lines (chord centerline) between a center point Pb' of the chord line on the boss portion and the center point Pt' of the chord line on the outer peripheral portion.

Also, in FIG. 3, a forward sweep angle $\delta\theta$ is defined as an angle formed between a straight line connecting the center point Pb' of the chord line on the boss portion 2 and a rotation center O, and a straight line connecting an intersection of an arbitrary radius R and chord centerline and the rotation center O.

Figure 4:
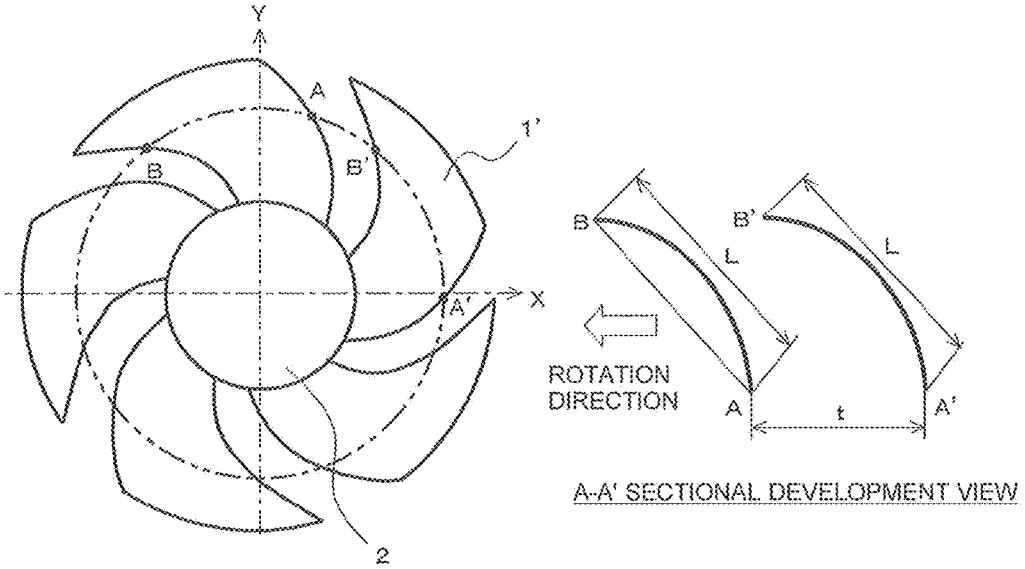
PRIOR ART FIG. 4
FIG. 4 is a diagram illustrating the definition of a chord-pitch ratio of the rotor blades of FIG. 2.

FIG. 4 is a diagram illustrating the definition of a chord-pitch ratio of the rotor blade 1' of FIG. 2.

In FIG. 4, an A-A' sectional development view is obtained by developing arcs of the cross sections of the rotor blades 1' along a line on the arbitrary radius R on a plane. When the chord length of the rotor blade 1' is L, and the blade pitch of the rotor blades 1 is t, a chord-pitch ratio $\sigma$ can be defined as $\sigma=L/t$.

Figure 5:
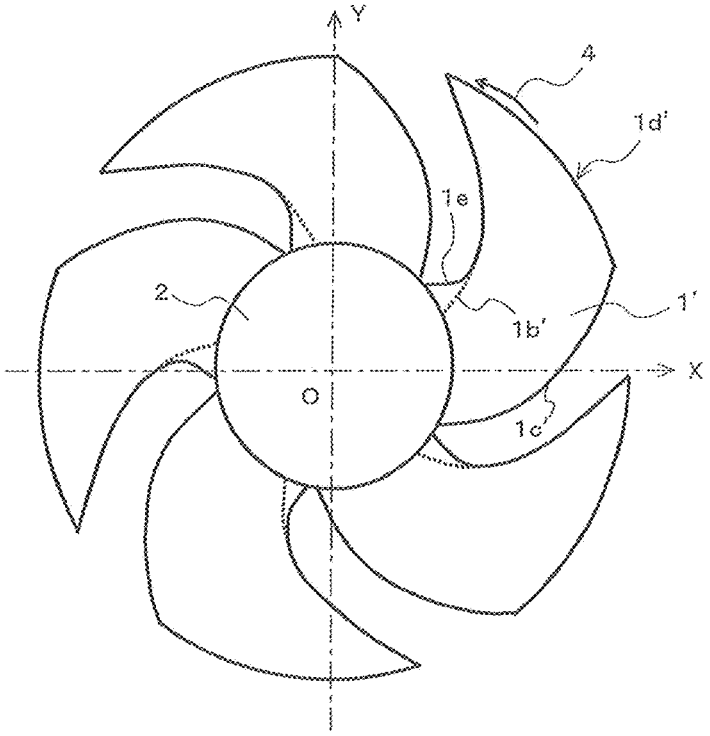
FIG. 5 is a plan view of rotor blades, in which the chord lengths of the bases of the blades are partially increased.

FIG. 5 is a plan view of an axial flow fan including rotor blades 1', in which the chord lengths of the bases of the blades are partially increased. When the chord length on the inner peripheral side of the blade is long (the chord length of the base of the blade is partially increased), a leading edge portion 1*e* is formed as in FIG. 5. As a result, the rotor blade 1' of FIG. 5 has an enlarged chord length at its base, and is formed such that the distribution of the chord length varies gradually toward a certain radius, and then varies linearly toward the outer periphery after exceeding the certain radius.

By forming the leading edge portion 1*e* of the rotor blade 1' as in FIG. 5, it is possible to increase the blade area only in the vicinity of the leading edge of the base of the blade, where the maximum stress is generated. Hence, concentration of stress can be reduced.

Note, however, that although the shape illustrated in FIG. 5 can ease stress, gaps between the base portions of the blades are reduced. Accordingly, there still remains the problem of difficulty in designing and manufacturing a die, when molding the rotor blade by integral molding or other methods.

The rotor blade of the Embodiment has been configured in view of the above issues, and the Embodiment will be described with reference to FIGS. 6 to 15.

Figure 6:
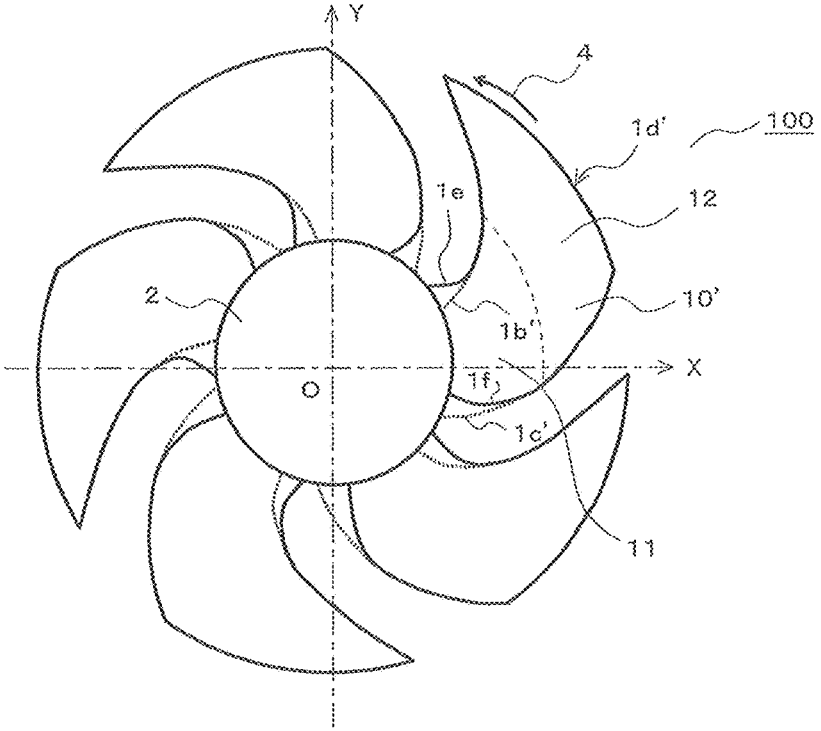
PRIOR ART FIG. 6
FIG. 6 is a plan view of an axial flow fan of an Embodiment of the present invention.

FIG. 6 is a plan view of an axial flow fan 100 of an Embodiment of the present invention.

A rotor blade 10' of the Embodiment is different from the shape of FIG. 5, in that it has a trailing edge portion 1*f*, which is formed by cutting a blade trailing edge portion 1*c*' of the base portion of the blade. Note that as in the case of the example of FIG. 2, the rotor blades 10' are the rotor blades of the Embodiment projected on a plane perpendicular to a rotation axis 3. The entire shape of the axial flow fan 100 of the Embodiment is basically the same as FIG. 1, and the rotor blades 10' each has a three dimensional shape, which is as a whole tilted rearward toward the downstream direction of the flow, and the blades are attached to a boss portion 2 in a radial manner.

The rotor blade 10' formed as in FIG. 6 has an increased blade area, in the vicinity of the leading edge of the base of the blade where the maximum stress is generated, and therefore can reduce concentration of stress. Moreover, to ensure gaps between the blades, the blade trailing edge portion 1*c*' varies a shape of the trailing edge in a curved manner. From the viewpoint of distribution of the forward sweep angle and distribution of the chord-pitch ratio, the shape of the rotor blade 10' is identified as follows.

The rotor blade 10' is segmented into a first area 11 extending from the boss portion 2 to the inner peripheral side of the blade, and a second area 12 on the outer peripheral side of the first area 11. The distribution of the forward sweep angle 60 of the rotor blade 10' increases while varying quadratically in the first area 11 (Note, however, that the maximum value is not larger than the forward sweep angle of the second area 12), and is linear (the final value of the first area 11 thereafter increases linearly) in the second area 12 (see FIG. 7 for details). Furthermore, the distribution of the chord-pitch ratio of the rotor blade 10' increases while varying in a curved manner from the base as the minimum value in the first area 11, and is linear (decreases substantially linearly) in the second area 12 (see FIG. 8 for details).

Although the rotor blade 10' of FIG. 6 receives slightly higher stress than the rotor blade of FIG. 5, strength analysis shows that stress can be eased by approximately 30(%), as compared to the rotor blade of FIG. 2. (See later-described FIGS. 12 and 13.)

Figure 7:
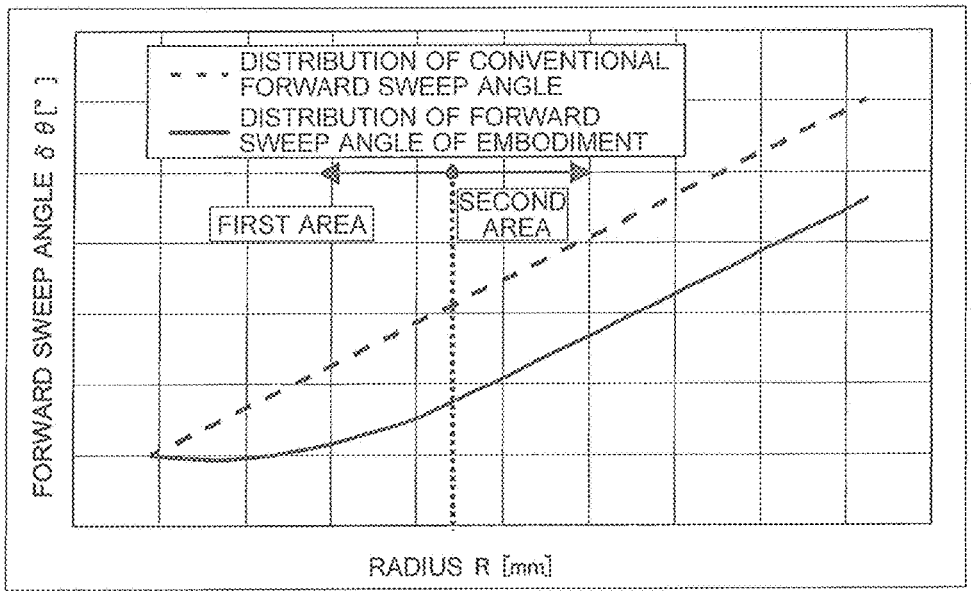
FIG. 7 is a diagram illustrating distribution of a forward sweep angle of a rotor blade of the Embodiment, and distribution of a forward sweep angle of a conventional rotor blade.

FIG. 7 is a diagram illustrating distribution of the forward sweep angle δθ of the rotor blade 10' of the Embodiment, and distribution of the forward sweep angle δθ of a conventional rotor blade. As described above, the forward sweep angle δθ of the rotor blade 10' of the Embodiment increases while varying quadratically in the first area 11, and has a linear distribution (increases linearly) in the second area 12. Meanwhile, the forward sweep angle δθ of the conventional rotor blade has a linear distribution (increases linearly) in both of the first area 11 and the second area 12.

Figure 8:
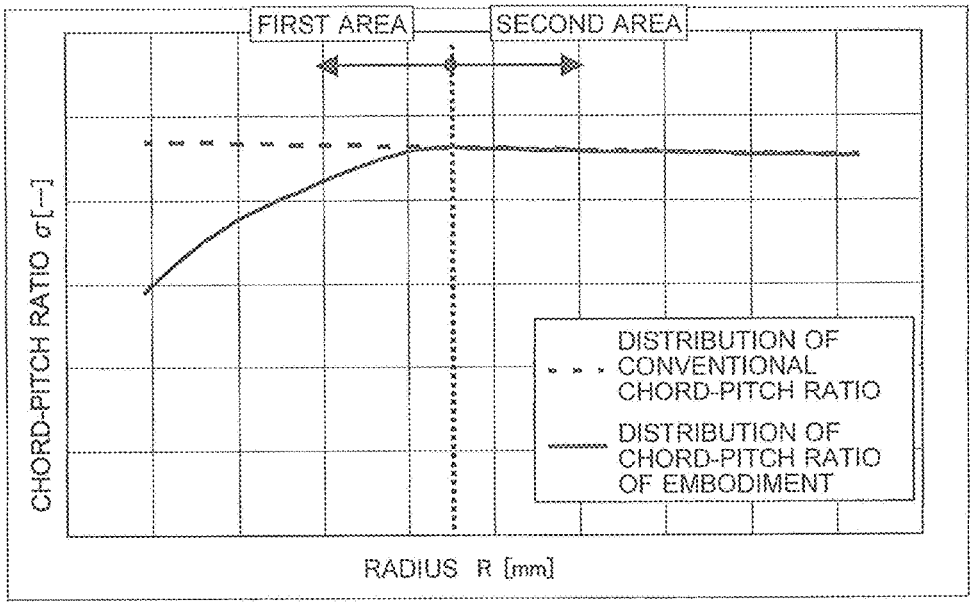
FIG. 8 is a diagram illustrating distribution of a chord-pitch ratio of the rotor blade of the Embodiment, and distribution of a chord-pitch ratio of the conventional rotor blade.

FIG. 8 is a diagram illustrating distribution of the chord-pitch ratio of the rotor blade 10' of the Embodiment, and distribution of the chord-pitch ratio of the conventional rotor blade. The chord-pitch ratio of the rotor blade 10' of the Embodiment increases while varying in a curved manner from the base as the minimum value in the first area 11, and has a linear distribution (decreases substantially linearly) in the second area 12. Meanwhile, the chord-pitch ratio of the conventional rotor blade has a linear distribution (decreases linearly) in both of the first area 11 and the second area 12.

The rotor blade 10' of the Embodiment illustrated in FIG. 6 can be achieved, by use of the distributions of the forward sweep angle and chord-pitch ratio illustrated in FIGS. 7 and 8. With the rotor blade 10' formed in this manner, it is possible to achieve an axial flow fan that can reduce concentration of stress and that can reduce deterioration of the air-blowing and noise characteristics.

In the rotor blade 10' of the Embodiment, for a rotor blade having an outer diameter Rt=130 (mm), the first area 11 is between the base of the blade and a position obtained by 0.65×Rt, and the distributions of the forward sweep angle and chord-pitch ratio illustrated in FIGS. 7 and 8 are applied. Note that in the Embodiment, the outer diameter Rt of the rotor blade 10' refers to the length between the rotation axis 3 and the outer periphery of the rotor blade 10'.

Figure 9:
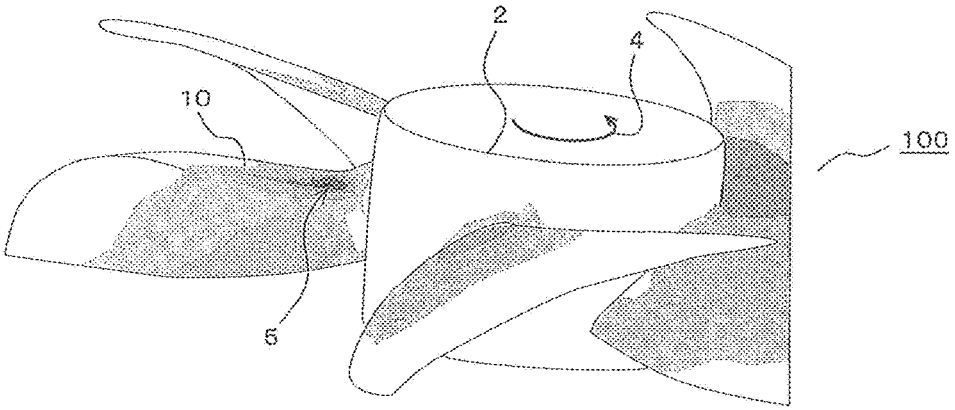
FIG. 9 is a diagram illustrating a stress-concentrating part of the rotor blade of the Embodiment.

FIG. 9 is a diagram illustrating stress distribution on a rotor blade 10.

As shown in FIG. 9, stress concentrates in a part 5 in the vicinity of the leading edge of the rotor blade 10, due to centrifugal force from the rotation.

Figure 10:
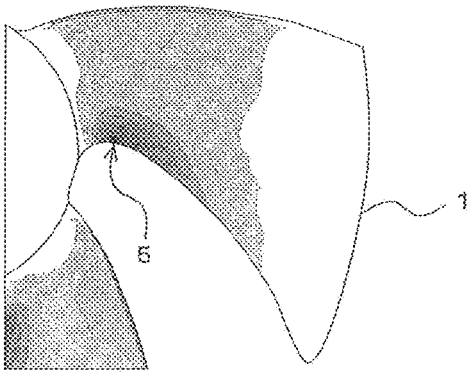
FIG. 10 is a diagram illustrating stress distribution on a conventional rotor blade.
Figure 11:
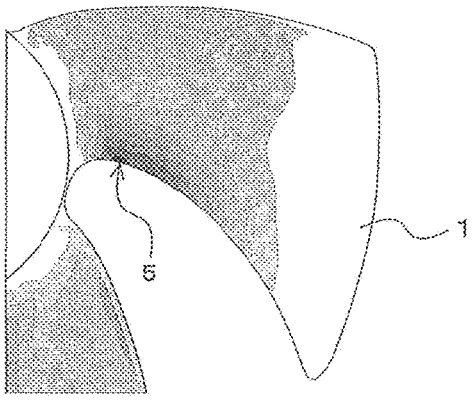
PRIOR ART FIG. 11
FIG. 11 is a diagram illustrating stress distribution on the conventional rotor blade (FIG. 5) whose chord length of the base is longer than other conventional blades.

FIG. 10 is a diagram illustrating stress distribution on a conventional rotor blade. FIG. 11 is a diagram illustrating stress distribution on the conventional rotor blade (FIG. 5) whose chord length of the base is longer than other conventional blades. FIG. 12 is a diagram illustrating stress distribution on the rotor blade of the Embodiment. FIG. 13 is a comparative table on the maximum stress.

When the stress distributions of FIGS. 11 and 12 are compared with the stress distribution of FIG. 10, it can be seen that concentration of stress in the vicinity of the leading edges of the rotor blades of FIGS. 11 and 12 are reduced. Also, when the maximum stresses were compared, as illustrated in FIG. 13, both the rotor blade having the extended chord length of the base (FIG. 5) and the rotor blade of the Embodiment can reduce the maximum stresses approximately −30(%) as compared with the conventional rotor blade.

Figure 15:
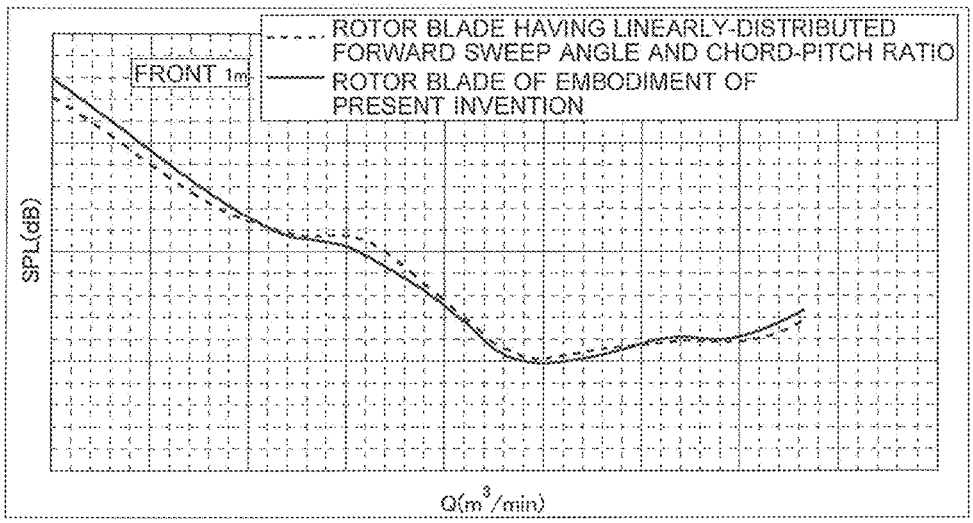
FIG. 15 is a diagram illustrating the air-blowing and noise characteristics of the rotor blade of the Embodiment and of the conventional rotor blade.

FIG. 14 is a diagram illustrating the air-blowing and static pressure characteristics of the rotor blade of the Embodiment and of the conventional rotor blade (the rotor blade of which the forward sweep angle and the chord-pitch ratio are distributed linearly). FIG. 15 is a diagram illustrating the air-blowing and noise characteristics of the rotor blade of the Embodiment and of the conventional rotor blade (the rotor blade of which the forward sweep angle and the chord-pitch ratio are distributed linearly).

The characteristics of FIGS. 14 and 15 show that around a practical use point, the air-blowing and static pressure or noise characteristics of the rotor blade 10 of the Embodiment do not differ largely from those of the conventional rotor blade.

In the above specific example, the example of "0.65×Rt" is used as the reference value for partitioning the first area 11 and the second area 12. The reason will be described below.

In the flow velocity distribution of out-blown air of a rotor blade formed as in FIG. 1, the area of high flow velocity concentrates in substantially 0.7 Rt to Rt (Rt: vane outer diameter), and therefore this area contributes largely to the air-blowing capacity. Since flow velocity is low on the part further inward, this part contributes less to the air-blowing capacity than the outer peripheral part. Hence, the reference value for varying the vane shape is preferably set within the range that contributes less to the air-blowing capacity. Also, from the viewpoint of strength, since a drastic change in the shape of the inner peripheral part would create a stress-concentrating part, moderate change of the shape within a range having less impact on the air-blowing capacity may not cause burden on the structure. For these reasons, the reference value is set to "0.65 Rt" in the specific example above. However, the reference value is not limited to "0.65 Rt," and for the above reasons, the objective of the present invention can be achieved by setting the value within the range of 0.5 Rt to 0.65 Rt.

As is clear from the description above, the rotor blade 10 (i.e., axial flow fan 100) of the Embodiment can improve the strength characteristic, while hardly impacting the air-blowing and noise characteristics. Additionally, when the rotor blade 10 is molded integrally by using resin or metal, a sufficient distance can be ensured between the blades to allow removal of a die, so that the die does not become thin, strength of the die can be ensured, and the molding can be performed by use of a simple die structure (a structure that is segmented in two parts in the axial direction and removed). In other words, there is no need to use a sliding die to partially change the die-removing direction only for the base of the rotor blade.

INDUSTRIAL APPLICABILITY

As has been described above, the axial flow fan of the present invention is applied to a ventilator, air conditioner, cooling fan and other air blowing devices as the fan that can ease stress in the stress-concentrating part of the rotor blade and that can reduce deterioration of the air-blowing and noise characteristics.

REFERENCE SINGS LIST 1, 10 rotor blade, 1', 10' rotor blade projected on plane perpendicular to rotation axis, 1*b*' blade leading edge portion, 1*c*' blade trailing edge portion, 1*d*' blade outer peripheral portion, 2 boss portion, 3 rotation axis, 4 rotation direction, A airflow direction, O rotation center, Pb, Pb' center point of chord line on boss portion, Pt, Pt' center point of chord line on blade outer peripheral portion, Pr, Pr' locus of center point of chord line (chord centerline), δθ forward sweep angle, L chord length, t blade pitch, σ chord-pitch ratio, 1*e* leading edge portion when chord length on inner peripheral side of blade is long, 1*f* trailing edge portion of the Embodiment, 5 stress-concentrating part, 11 first area, 12 second area, 100 axial flow fan

The invention claimed is:

1. An axial flow fan comprising:

a boss portion configured to be rotationally driven by a motor; and a plurality of rotor blades attached to the boss portion in a radial manner and being configured to blow air in a rotation axis direction, each of the plurality of rotor blades being segmented into a first area extending from the boss portion toward an outer peripheral side and a second area connected to the first area and extending from the first area to an outermost periphery of the rotor blade, wherein a distribution of a forward sweep angle varies quadratically in the first area, and a maximum value of the forward sweep angle in the first area is a value not larger than the forward sweep angle in the second area, and wherein a distribution of a chord-pitch ratio varies in a curved manner from a base as a minimum value in the first area, and is linear in the second area.

2. The axial flow fan of claim 1, wherein the distribution of the forward sweep angle is linear in the second area.

3. The axial flow fan of claim 2, wherein each of the plurality of rotor blades has a shape as a whole tilted rearward toward a downstream direction of an airflow.

4. The axial flow fan of claim 1, wherein each of the plurality of rotor blades has a shape as a whole tilted rearward toward a downstream direction of an airflow.

* * * * *